US009643744B2

(12) United States Patent
Benz

(10) Patent No.: US 9,643,744 B2
(45) Date of Patent: May 9, 2017

(54) METHOD AND DEVICE FOR PACKING TUBES OR CANS

(71) Applicant: Texa AG, Haldenstein (CH)

(72) Inventor: Gottlieb Benz, Flums (CH)

(73) Assignee: TEXA AG, Haldenstein (CH)

( * ) Notice: Subject to any disclaimer, the term of this patent is extended or adjusted under 35 U.S.C. 154(b) by 530 days.

(21) Appl. No.: 14/197,167

(22) Filed: Mar. 4, 2014

(65) Prior Publication Data

US 2014/0305078 A1 Oct. 16, 2014

(30) Foreign Application Priority Data

Apr. 11, 2013 (CH) ..... 758/13
May 29, 2013 (CH) ..... 1029/13

(51) Int. Cl.

| | |
|---|---|
| ***B65B 13/18*** | (2006.01) |
| ***B65B 13/04*** | (2006.01) |
| ***B65B 35/30*** | (2006.01) |
| ***B65B 27/04*** | (2006.01) |
| *B65B 57/00* | (2006.01) |

(52) U.S. Cl.

CPC ..... *B65B 13/04* (2013.01); *B65B 27/04* (2013.01); *B65B 13/186* (2013.01); *B65B 13/188* (2013.01); *B65B 57/00* (2013.01)

(58) Field of Classification Search

CPC ..... B65B 13/18; B65B 13/04; B65B 27/04; B65B 13/186; B65B 13/188
USPC ..... 53/399, 582, 589, 398, 48.7
See application file for complete search history.

(56) References Cited

U.S. PATENT DOCUMENTS

| | | | | |
|---|---|---|---|---|
| 3,073,086 | A * | 1/1963 | Martin | B65B 13/28 53/398 |
| 4,174,662 | A * | 11/1979 | Klusmier | B65B 27/10 100/7 |
| 5,704,195 | A * | 1/1998 | Benz | B65B 5/08 53/148 |
| 7,308,779 | B2 * | 12/2007 | Benz | B65B 5/08 414/416.09 |

* cited by examiner

*Primary Examiner* — Robert Long
*Assistant Examiner* — Xavier A Madison
(74) *Attorney, Agent, or Firm* — DWC Law Firm, P.S.; David Chen

(57) ABSTRACT

A method for packing tubes or cans is proposed which arrive continuously from a production line and are taken over by a transport unit by means of a grouping unit. The transport unit transports the tubes or cans in a desired formation into a retaining hoop of a strapping unit, wherein the retaining hoop is able to grip the formation in a pincer-like movement, whereupon the formation is strapped using a plastic band and transported further. The transport is achieved by means of two spike plates which are used alternately.

10 Claims, 6 Drawing Sheets

METHOD AND DEVICE FOR PACKING TUBES OR CANS

REFERENCE TO RELATED APPLICATIONS

This application claims priority to Swiss patent applications no. CH-00758/13, filed Nov. 4, 2013, and CH-01025/13, filed May 29, 2013, the disclosures of which are hereby incorporated by reference.

TECHNICAL FIELD

The present invention relates to a method for packing tubes or cans which arrive from a production line and are arranged in groups of adjacently arranged tubes or cans with a specifiable unit number by means of a grouping unit, whereby these groups are each taken over by a transport unit.

The invention also relates to a plant for packing tubes or cans, comprising a grouping unit interacting with a tube or can production line, a transport unit for feeding groups into a strapping unit, in which the groups assembled in a certain formation can be strapped together.

BACKGROUND

Nowadays cans or tubes are manufactured in extremely efficient production lines and then need packing for further shipment. This is done by either placing the tubes or cans into boxes or by assembling them into larger formations which are then strapped together, whereupon these formations are placed on pallets and shipped.

To this end the applicant has developed special grouping units in which the tubes or cans continuously arriving from a production line are arranged in groups of adjacent tubes or cans with a specifiable unit number, whereupon these groups are each handed over to a transport unit. This transport is often a pusher which pushes these cans or tubes into a carton, layer by layer.

Furthermore for intermediate transport the applicant has also developed an auxiliary form, usually in the shape of a hexagon, into which the grouped tubes or cans are pushed layer by layer to be then transported further to a strapping station. Such a solution is shown in the DE 1 0006 484 A.

The market also offers packaging plants, in which tubes or cans are picked up group-wise by means of a handling robot so that a formation is formed which is then strapped.

Furthermore the applicant has developed a method and an apparatus for packing tubes or cans, where the cans or tubes are pushed by the grouping unit onto a plate with a plurality of spikes arranged tightly together, until a desired formation is formed, whereupon this spike plate conveys this formation of tubes and cans further in order for them to be packed into boxes. In order to be able to achieve the required output, such a plant nowadays preferably comprises two such spike plates which in turn interact with the grouping unit.

Although such a packaging plant admittedly operates at high speed, these days production lines are operated at constantly increasing speeds, and the known plant according to European Patent EP 1 656 298 has reached its limit of performance.

In order to increase its performance, it would be possible to increase the strapping speed thereby gaining a few tenths of a second, but as the strapping speed increases, so does the pulse with which the plastic strap is whipped around the formation thereby often causing damage to the tubes or cans in the outer circumferential regions. One of the reasons for this is that the tubes as well as the cans are manufactured with an ever decreasing wall thickness.

During strapping the formation of tubes or cans must remain fixed in its position, and therefore the spike plate or the handling robot cannot let go of the formation and return to the grouping unit until strapping of the formation of cans or tubes has been completed.

SUMMARY

It is therefore the requirement of the invention to propose a method and a plant, with which tubes or cans arriving from a production line can be fixed and strapped faster.

This requirement is met by a method of the kind mentioned in the beginning in that a transport unit fixes the tubes or cans in a desired formation within a retaining hoop which is part of a strapping unit, whereupon the transport unit immediately returns to the grouping unit, and the formation of tubes or cans in the retaining hoop is strapped at least once and the strapped formation is then transported further.

The invention further solves the requirement to propose a plant for packing tubes or cans of the kind mentioned in the beginning, which is able to solve the requirement, and which is characterised in that the strapping unit comprises a replaceable retaining hoop adjusted to the shape of the formation to be formed.

A preferred embodiment of the plant according to the invention will now be described and the method according to the invention will be explained with reference to this plant by way of the attached drawings.

BRIEF DESCRIPTION OF THE DRAWINGS

As mentioned a preferred embodiment of the plant according to the invention is shown in the drawings, in which.

DETAILED DESCRIPTION

Figure 1:
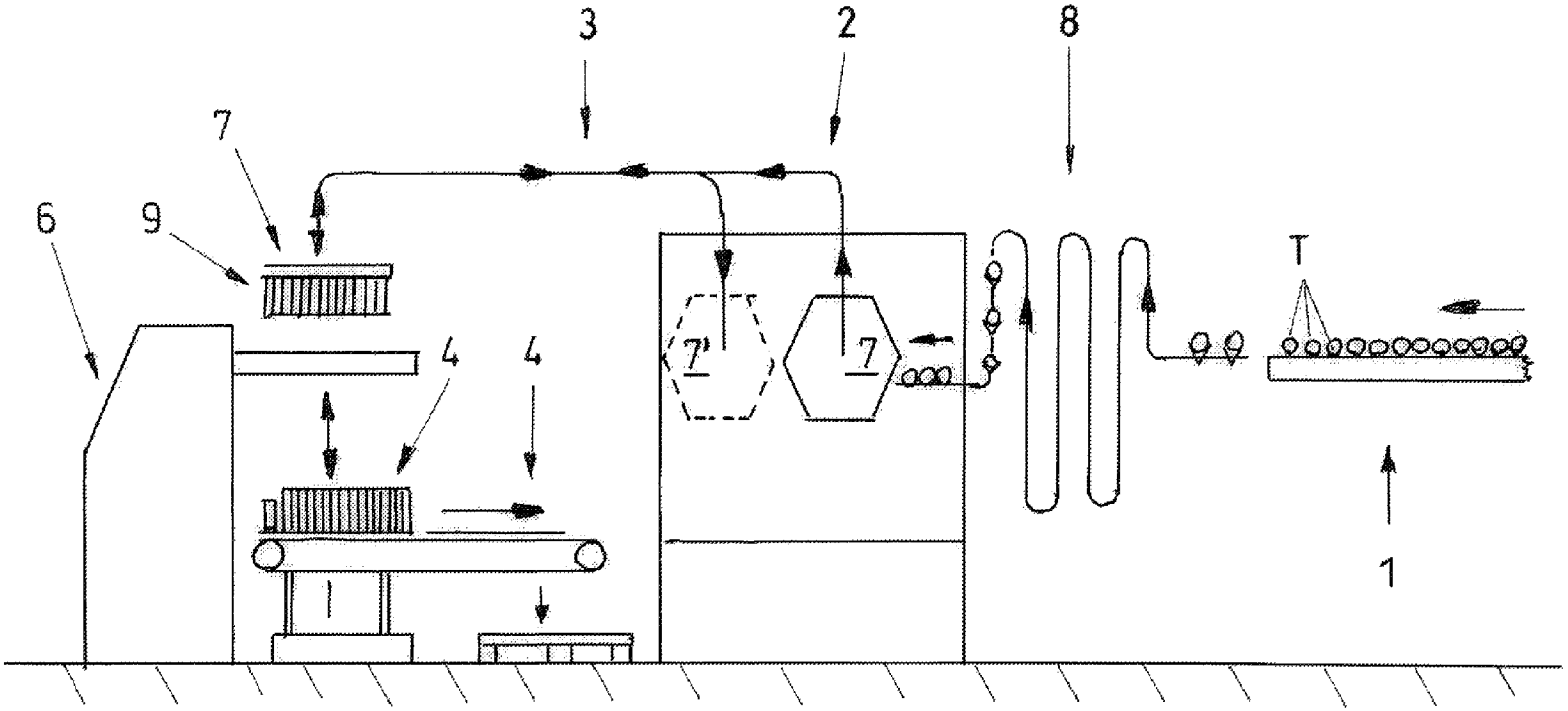
FIG. 1 shows a schematic illustration of the various units of a packing plant for illustrating the various method steps.

FIG. 1, as mentioned, shows a schematic view of the packing unit as a whole for packing tubes or cans. The box open towards the right in the drawing shows the end of the production line 1. This is where the tubes or cans continuously arrive in order to be passed on to a grouping unit 2 which, for example and preferably, is configured according to the embodiment described in EP 1 114 784 B1. Then follows a transport unit 3 with at least one spike plate 7, 7' which, for example and preferably, corresponds to an embodiment according to EP 1 656 298 B1. An intermediate store 8 is usually inserted between the production line 1 and the grouping unit 2, which store is used when the spike plate 7, 7' needs to be changed. The spike plate 7, 7' is forwarded by the grouping unit 2 to a strapping unit 6, where the cans or tubes T are taken over. While the first spike plate 7 transports a completed formation of tubes or cans to the strapping unit 6, a second spike plate 7' (not shown here) is refilled. As soon as the first spike plate 7 has passed the tubes on to the strapping unit 6, it is immediately returned to the grouping unit and is kept there waiting until the second spike plate 7' has been filled and moved to the strapping unit 6 so that the first spike plate 7 is again ready to be filled.

In the grouping unit, two groups of adjacently arranged tubes or cans are arranged with a specifiable unit number and are taken over group-wise by the transport unit. This is preferably effected in that these groups of tubes or cans are pushed onto a spike plate 7, 7', which forms part of the transport unit 3.

Essentially the transport unit 3 consists of usually two spike plates 7, 7' and a means for moving these spike plates 7, 7' from the grouping unit 2 to the strapping unit 6. This may be achieved by means of a handling robot which grips a respectively filled spike plate and moves it to the strapping unit 6. As soon as the formation 9 of tubes or cans T has been passed on to the strapping unit, this spike plate is returned to the grouping unit and brought into a waiting position which is shown as a dashed line. Moving the respective spike plate from the waiting position into the loading position can then be achieved by a means arranged on the grouping unit 2 or a further handling robot.

As soon as one of the two spike plates 7, 7' is completely filled, the spike plate is removed from the grouping unit 2 and moved, after it has been raised, to the strapping unit 6. This strapping unit 6 comprises a receiving arch 13 with a retaining hoop 5 arranged inside it. The filled spike plate 7, 7' together with the cans or tubes held thereon by the spikes is moved into the retaining hoop 5 and deposited on a raised work table 4, whereupon the spike plate pushes all the tubes and cans off and is able to immediately return to the grouping unit 2 ready for the next loading.

The retaining hoop 5 then grips the formation 9 thereby fixing all the tubes and cans. The formation 9 is then strapped in a conventional manner by means of a plastic band K. Once the formation has been strapped, the work table 4 is raised from a lower position and the formation 9 of tubes or cans T is strapped a second time. Then the strapped formation 9 is lowered into the lowermost position by means of the transport table 4' and moved on. From here it can be automatically moved onto a pallet.

With regard to further details of the method and the preferred plant for executing the method reference should be made to the figures below and their description.

Figure 2:
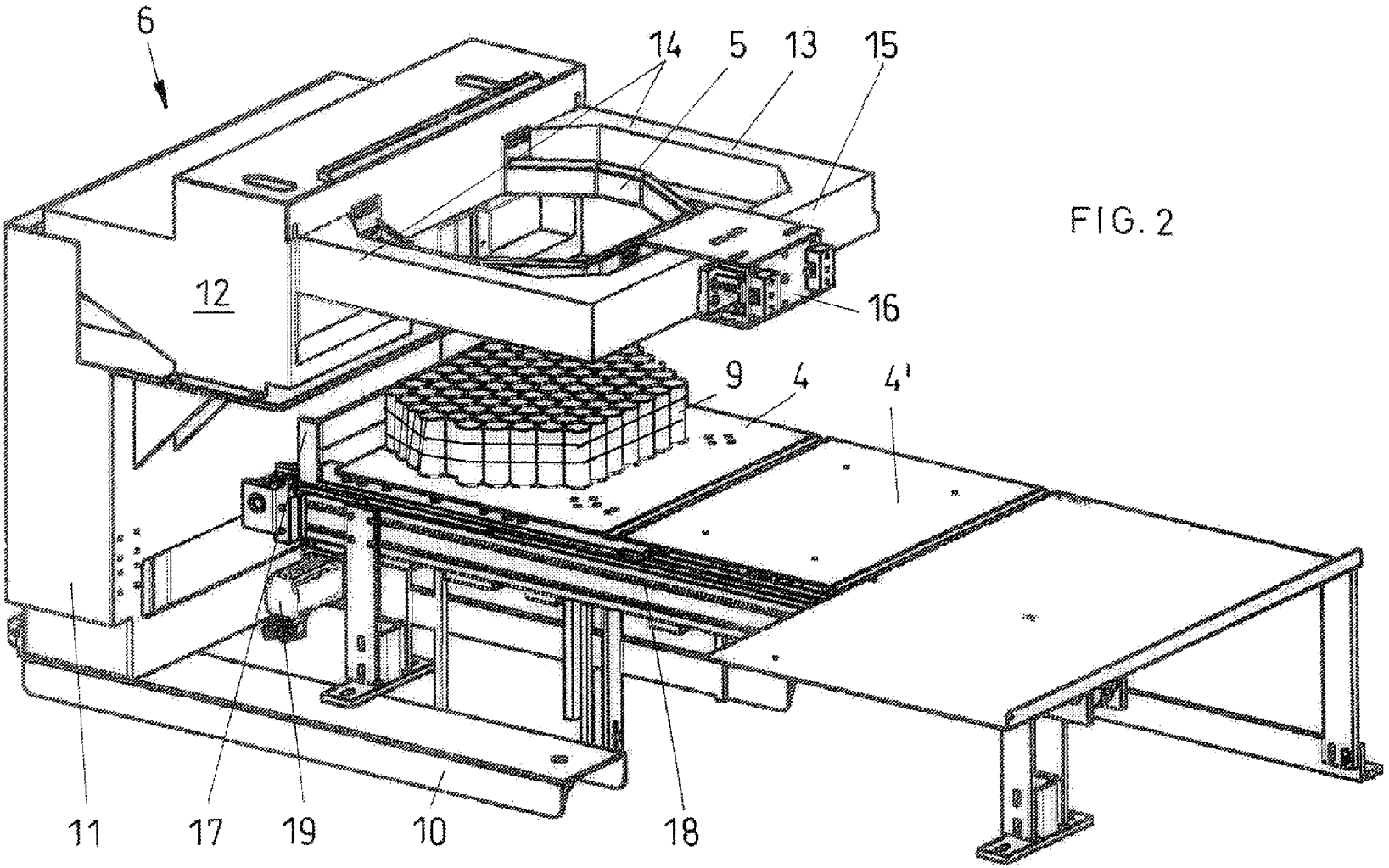
FIG. 2 shows a perspective illustration of the strapping unit with a delivered formation of tubes or cans.

In FIG. 2 the strapping unit 6 is shown in detail on an enlarged scale together with the work table 4 and an adjoining transport table 4'. The strapping unit 6 comprises a chassis 10 with a housing 11 fixed on it. In this housing 11 at the upper end of it the already mentioned receiving arch 13 has been arranged. The strapping unit 6 also includes a box 12 in which is arranged a conventional strapping device such as marketed by Messrs. Simplex AG. The box 12 has the horizontal receiving arch 13 overhanging the work table 4 and extending approximately in parallel thereto moulded onto it. This receiving arch 13 consists of two longitudinal arms 14 and a yoke beam 15 connecting these longitudinal arms. Here a control unit has been arranged on this yoke beam 15. This control unit 16 can for example monitor the presence or absence of a spike plate 7, 7' and can trigger the subsequently necessary method steps if a formation 9 of cans or tubes T is present. In the present case this would consist of moving the work table 4, monitoring the position of the work table 4, then triggering a clamping movement of the retaining hoop 5 and subsequently triggering a strapping operation. Thereafter the work plate can either be raised a bit more or lowered a bit more, followed by a second strapping operation and then the strapped formation 9 can be lowered to the level of the transport table 4'.

At the end of the work table 4 facing the housing 11 of the strapping unit 6, a stop strip 17 has been provided. This stop strip 17 serves the purpose of moving the formed formation 9 along. Once the strapped formation 9 on the work table 4 has been lowered, the stop strip 17 is moved via a chain drive 18 driven by an electric drive motor 19 in direction of the transport table 4' in order to position the strapped formation on this table. From here the strapped formation 9 may, for example, be deposited on pallets.

Figure 3:
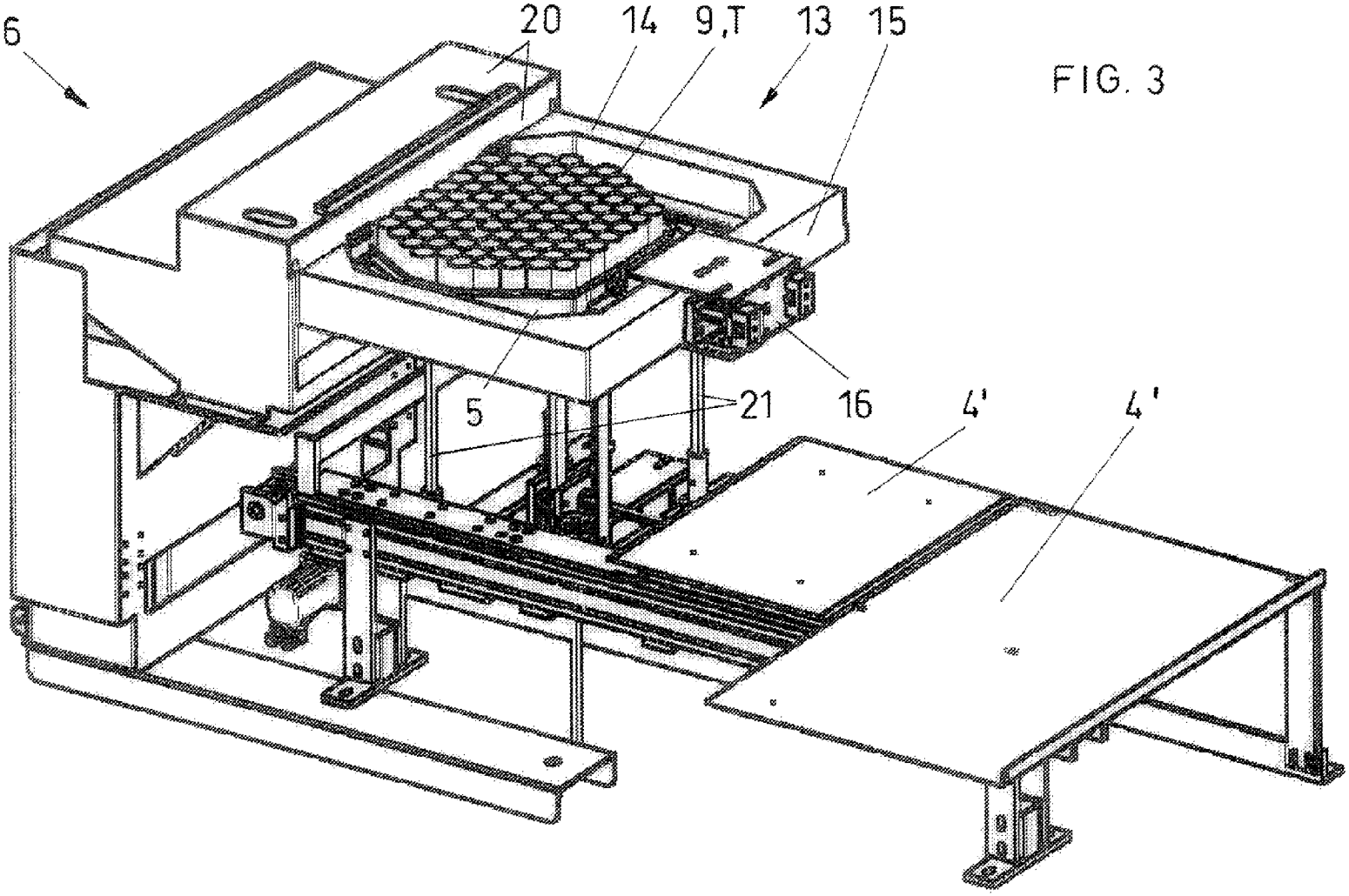
FIG. 3 shows the same view of the strapping unit with a raised work surface and a strapped formation of tubes or cans.
Figure 4:
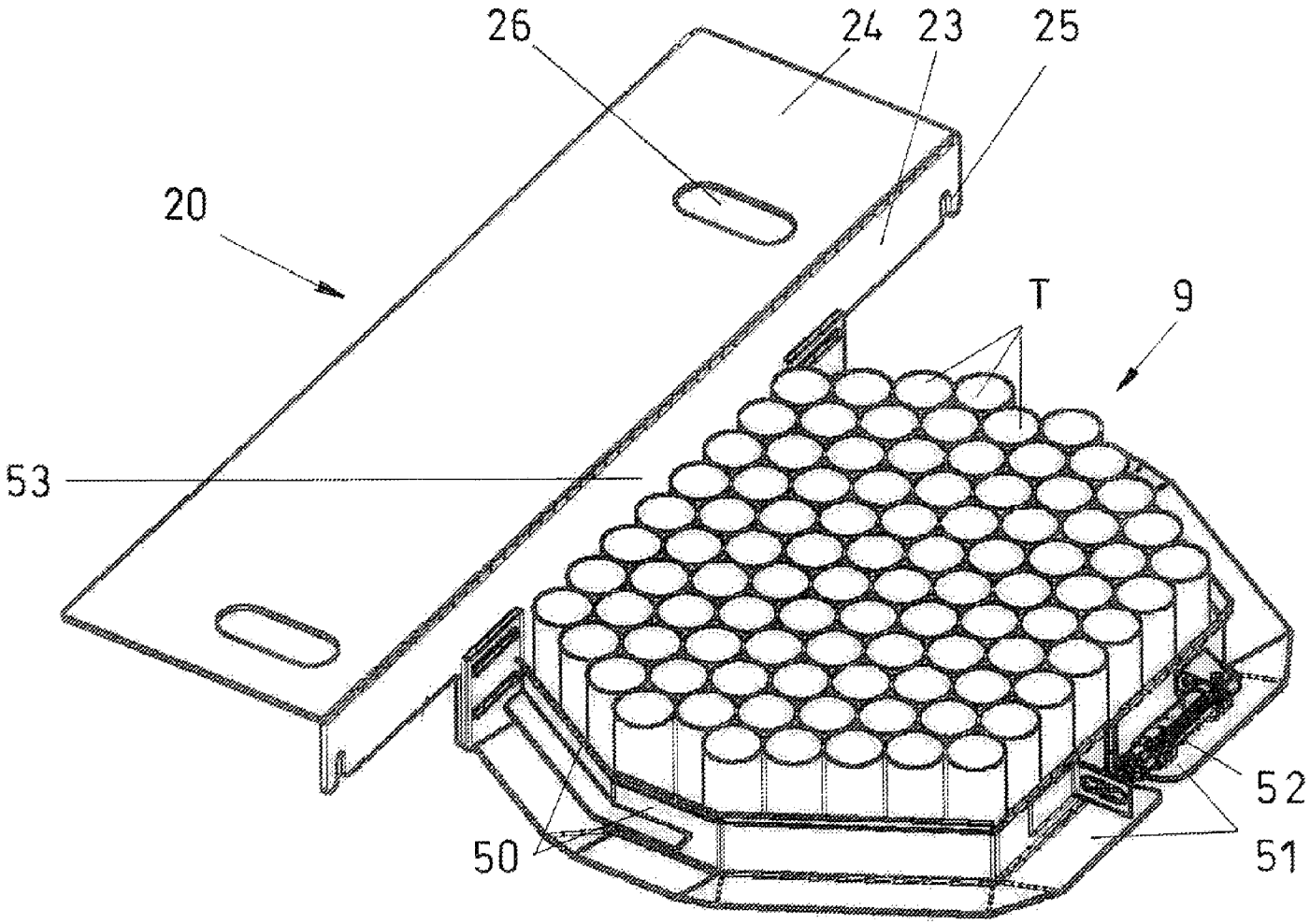
FIG. 4 again shows a perspective view of the retaining hoop exclusively.
Figure 5:
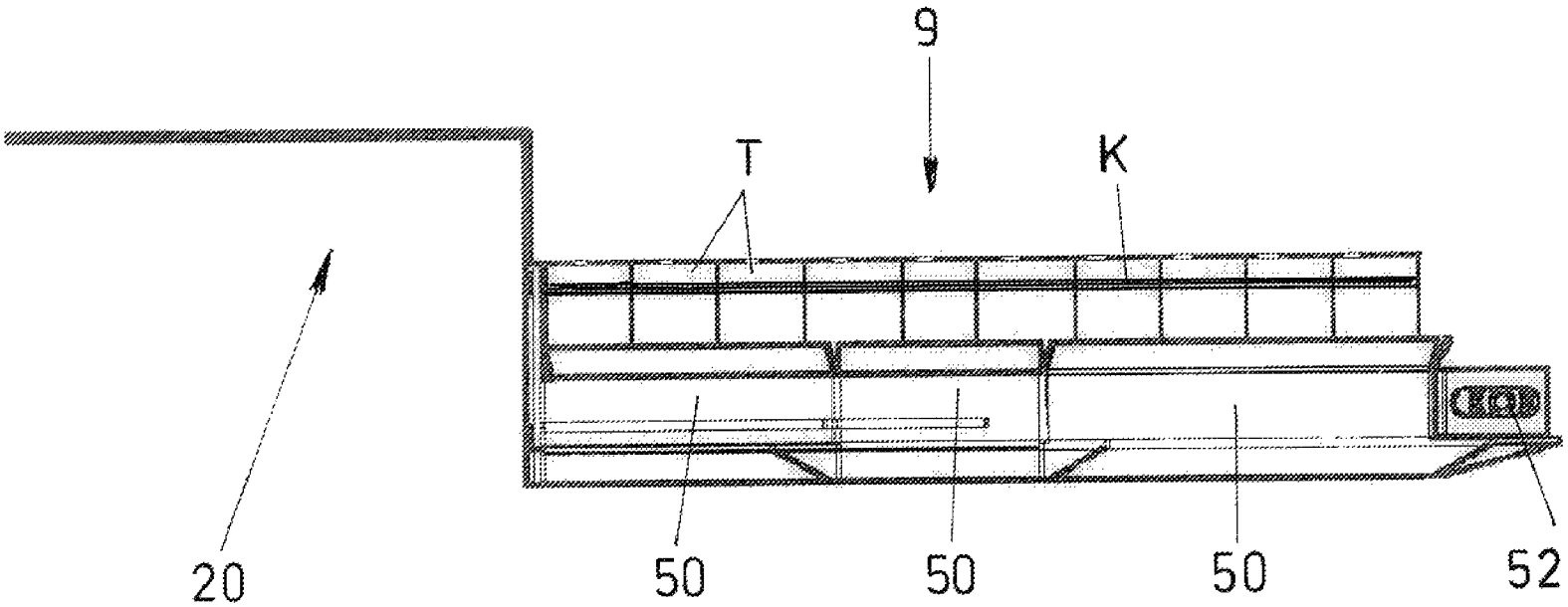
FIG. 5 shows the same view of the retaining hoop, but as a side view.

FIG. 3 shows again a perspective view of the strapping unit 6 with just the transport table 4. Here the transport table is raised. The formation 9 of tubes or cans T is situated within the retaining hoop 5. The shown shape of formation 9 of tubes or cans T here is hexagonal. In this arrangement the formation is supported with one side edge against a front plate 20. The other five sides of the hexagonal formation are formed by the retaining hoop 5. The detailed construction of the retaining hoop 5 will be discussed at a later stage.

Since the work table 4 is in a raised position, it is itself not visible; the lifting means 21, on the other hand, by means of which the work table 4 can be raised and lowered, are visible. The lifting means 21 may be piston cylinder units or lifting spindles. In principle it should suffice to provide only one active lifting means 21 and glidingly mounted guiding rods. For accurate guidance however it may be helpful to provide two or more actively operable synchronously running lifting means 21.

Also clearly visible in this Figure is the stop strip 17 which is still in its end position. When the formation 9 has been strapped as desired, the work surface 4 is again lowered and the stop strip 17, which is connected with a chain drive or toothed belt drive, is activated and pushed forward in direction of the transport table 4' by the control unit 16 or a central control unit not shown here.

As already mentioned, the preferred way of constructing the retaining hoop 5 would be to have it firmly connected with a front plate 20 so that the combination of retaining hoop 5 and front plate 20 as a whole can be exchanged in a most simple manner. This exchange takes place in particular when another size of tubes or cans T are assembled to form a formation and need strapping. As can be clearly recognised the combination of front plate 20 and retaining hoop 5 may be constructed as purely a pushfit unit of the strapping unit 6. The front plate 20 is L-shaped in cross-section. The face of the shorter shank lies inside the housing 11. The substantially longer shank 24 forms part of the cover of housing 11. The shorter shank 25 comprises slots 23 on the sides which form part of a guide of a pushfit support of the front plate 20 together with the box 10. The longer shank 24 has two approximately oval recesses 26 provided in it. These recesses are used as an aid in gripping the front plate 20 when it needs to be exchanged.

The retaining hoop 5, as shown, is preferably composed of different portions of L-profiles. The short shank 25 of front plate 20 forms a portion 53, against which the formation 9 to be strapped is supported. The portions of the retaining hoop 5 as such are marked with 50. The portion 51 which lies opposite the short shank 25 of front plate 20 and/or opposite the portion 53 is separated. These two separated portions 51 are connected with each other via an actuating element 52. This actuating element may, for example, be a hydraulic or pneumatic piston cylinder unit or may be implemented as a unit consisting of a screw spindle with electromotoric actuator. Alternatively the actuating element 52 may be an electrically activated lifting magnet. The pincer-like movement of the retaining hoop 5 consists of a very short movement. That is why the retaining hoop 5 can be constructed without hinges. The retaining hoop 5 is dimensioned such that it exactly corresponds to the circumference of the formation 9 to be strapped. However, in order to facilitate the introduction of the tubes or cans held on the spike plate, the retaining hoop 5 is lightly prized open by means of the mentioned actuating element 52. Preferably the prize-open path covers between just a few millimeters and a maximum of 3 centimeters.

It is, of course, possible for the retaining ring 5 to comprise one or more hinges, and in this case both the opening and the closing movement of the retaining hoop 5 must be effected actively. However since such a solution is expensive both as regards manufacture and operation, the first mentioned solution is preferred.

Figure 6:
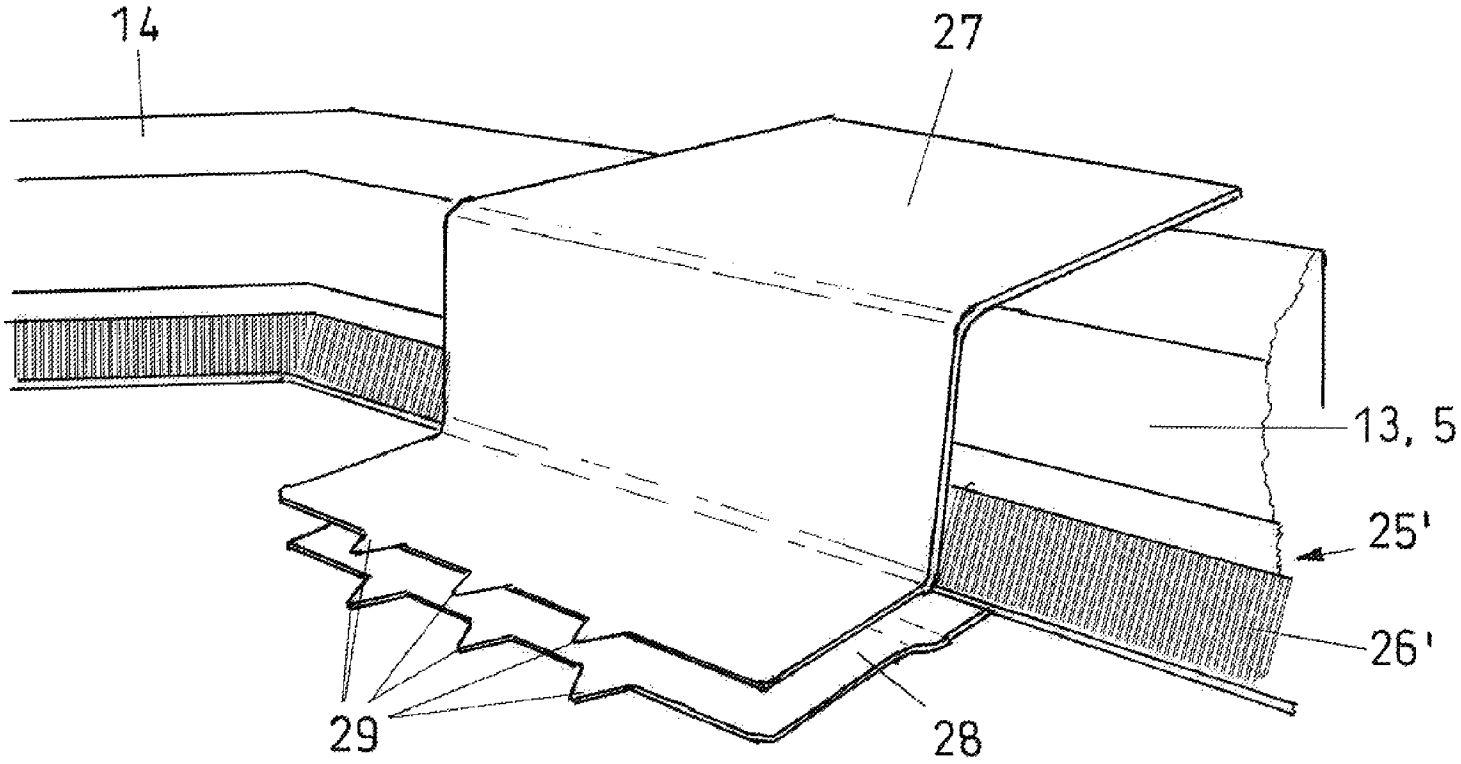
FIG. 6 shows how the strapping band is guided in the strapping unit.

FIG. 6 shows a partial view of the receiving arch 13. The view is from the inside onto the yoke beam 15 and onto a part of the two longitudinal arms 14. Both the yoke beam 15 and the two longitudinal arms 14 are provided with a circumferential slot-like opening 25' on the side facing the centre. This circumferential slot-like opening 25' is substantially covered by a brush 26'. The strapping band is guided in the receiving arch 13 and is pulled out of the receiving arch 13 during tightening, wherein the brush 26' moves this strapping band into the lower region. As the strapping band is tightened, it is intended to settle in an exactly defined position against the formation 9. This is achieved by suitably designed guiding plates. In the figure an upper guiding plate 27 and a lower guiding plate 28 can be recognised. Both guiding plates are exchangeably attached because these guiding plates must be adjusted to the diameter of the cans or tubes to be strapped, and the teeth 29 provided on these guiding plates 27, 28, in their adjacent distance, must correspond to the diameter of the cans to be strapped. It is essential that the strapping band comes to settle against the cans, not at a random point, but at a defined height. Therefore these guiding plates 27, 28 are of considerable importance. In particular with cans to be strapped, these may be diverse in shape, essentially there are e.g. cylindrical shapes or cylindrical shapes which are tailored in the centre region. The strapping bands must, of course, be applied only in the cylindrical regions. In particular in the lower cylindrical region of such cans it is of immense importance that they are not pressed together too closely in the bottom region. Aluminium cans are usually somewhat thicker in the bottom region than in the cylindrical region above it. In the industry this phenomenon is known as a so-called elephant's foot. Preferably the strapping is therefore carried out initially in the upper cylindrical region, and it is not until after this strapping has already taken place and the cans are in a relatively stable position in relation to each other, that strapping in the lower region is carried out. This has the effect of avoiding can deformation in the said region. Should such deformations occur, this produces visible impressions which would not be acceptable to manufacturers.

The guiding plates 27, 28 are arranged on the yoke beam 15 in the area of the control unit 16. As soon as the formation 9 is placed inside the retaining hoop 5, the retaining hoop 5 grips the formation so that the cans are packed closely together, whereupon the guiding plates 27 and 28 are pushed towards the centre with the teeth 29 engaging between individual tubes or cans. The teeth 29 are dimensioned such that they do not come into contact with the cans, in the same way in which the guiding plates 27 and 28 do not make contact, but they merely result in the strapping band settling in the exact position.

LIST OF REFERENCE SYMBOLS

1 production line
2 group unit
3 transport unit
4 work table
4' transport table
5 retaining hoop
6 strapping unit
7 spike plate
7' second spike plate
8 intermediate store
9 formation of tubes or cans
10 chassis
11 housing
12 box
13 receiving arch
14 longitudinal arms
15 yoke beam
16 control unit
17 stop strip
18 chain drive
19 electric drive motor
20 L-shaped front plate
21 lifting means
22 slots
23 long shank of front plate 20
24 short shank of front plate 20
25 oval recesses in front plate
25' circumferential opening
26' brush
27 upper guiding plate
28 lower guiding plate
29 teeth of the guiding plates 27, 28
50 portion of the retaining hoop
51 portion separated by a slot
52 actuating element
53 portion
T tubes or cans
K plastic band

What is claimed is:

1. A method for packing tubes or cans which arrive from a production line comprising:

the tube or cans being arranged in groups of adjacently arranged tubes or cans with a specifiable unit number by means of a grouping unit and the groups being each taken over by a transport unit, wherein the transport unit fixes the tubes or cans in a desired formation within a retaining hoop which is part of a strapping unit, whereupon the transport unit returns immediately to the grouping unit, and the formation of tubes or cans within the retaining hoop is strapped at least once and the strapped formation is then transported further;

wherein the transport unit comprises at least one spike plate onto which the tubes or cans are pushed in groups by the grouping unit until the formation being formed is complete;

wherein the loaded spike plate is moved from the grouping unit to the strapping unit and from there, from above, moves the tubes or cans into the retaining hoop, deposits the tubes or cans onto a raised work table and then returns immediately, whereupon at least one strapping operation of the formation is carried out; and wherein the deposited formation strapped once is lowered by means of the work table for a specifiable distance or is raised in order to carry out a second strapping operation.

2. The method according to claim 1, wherein the strapped formation is lowered by means of the work table to the level of an adjacent transport table and is pushed onto the transport table by means of a movable stop strip.

3. The method according to claim 1, wherein, prior to strapping, guiding plates are brought into position.

4. A plant for packing tubes or cans comprising:

a grouping unit interacting with a tube or can production line;

a transport unit for feeding groups of packing tubes or cans into a strapping unit in which groups of packing tubes and cans held together in a formation can be strapped, wherein the strapping unit comprises an exchangeable retaining hoop adjusted to a shape of the formation to be strapped;

wherein the retaining hoop consists of two parts indirectly connected with each other and is able to grip the formation of tubes or cans in a pincer-like movement with the aid of an actuating element; and wherein the retaining hoop performing a pincer-like movement is surrounded by a receiving arch.

5. The plant according to claim 4, wherein the retaining hoop is configured without joints and opened out by means of the actuating element and is able to grip the formation in a pincer-like movement while elastically recovering.

6. The plant according to claim 4, wherein the receiving arch serves to guide and protect a plastic band used for strapping, and comprises the strapping unit in a housing in which a market-standard strapping apparatus is housed.

7. The plant according to claim 6, wherein the housing comprises a L-shaped plate which as a pushfit can be hooked onto the housing, wherein the retaining hoop is firmly attached with the L-shaped plate to a shorter shank of the L-shaped plate.

8. The plant according to claim 7, wherein the retaining hoop is formed from several portions by bending or welding and whereby the front plate with its shorter shank is a portion of the formation to be strapped, whilst the portion lying diametrically opposite to the portion consists of two partial portions separated by a gap for the actuating element to engage on.

9. The plant according to claim 4, wherein the retaining hoop is arranged inside a circumferential receiving arch of the strapping unit and the retaining hoop consists of two longitudinal arms and a yoke beam in which the plastic band used for strapping is guided, wherein the longitudinal arms and the yoke beam comprise a circumferential opening in direction of the center, which opening is covered at least partially by a brush.

10. The plant according to claim 9, wherein an upper guiding plate and a lower guiding plate each comprise teeth and are replaceably arranged on the yoke beam so as to be in alignment with the edges of the circumferential opening.

* * * * *